US006017198A

United States Patent [19]

Traylor et al.

[11] Patent Number: 6,017,198

[45] Date of Patent: Jan. 25, 2000

[54] SUBMERSIBLE WELL PUMPING SYSTEM

[76] Inventors: Leland B Traylor, 11510 Ranchites Ave NE., Albuquerque, N.Mex. 87122; John R Nelson, 7709 Vista del Arroyo NE, Albuquerque, N.Mex. 87109

[21] Appl. No.: 08/805,616

[22] Filed: Feb. 26, 1997

Related U.S. Application Data

[60] Provisional application No. 60/012,462, Feb. 28, 1996.

[51] Int. Cl.[7] ..... F04B 9/08

[52] U.S. Cl. ..... 417/390; 417/366; 417/390; 417/392; 417/394; 417/473; 417/533; 417/539; 92/512; 166/65.1; 166/105

[58] Field of Search ..... 417/366, 390, 417/392, 394, 473, 533, 539; 92/512; 166/65.1, 105

[56] References Cited

U.S. PATENT DOCUMENTS

| | | | |
|---|---|---|---|
| 2,435,179 | 1/1948 | McGovney . | |
| 2,644,401 | 7/1953 | Ragland | 417/394 |
| 2,861,518 | 11/1958 | Pleuger . | |
| 2,961,966 | 11/1960 | Zillman . | |
| 3,739,073 | 6/1973 | Scheinder et al. | 166/65.1 |
| 3,749,526 | 7/1973 | Ferrentino | 417/394 |
| 4,346,256 | 8/1982 | Hubbard . | |
| 4,490,095 | 12/1984 | Soderberg | 417/392 |
| 4,665,281 | 5/1987 | Kamis . | |
| 4,902,206 | 2/1990 | Nakazawa et al. | 417/394 |
| 5,146,982 | 9/1992 | Dinkins . | |
| 5,269,377 | 12/1993 | Martin . | |

*Primary Examiner*—Charles G. Freay
*Attorney, Agent, or Firm*—Alberto A. León

[57] ABSTRACT

The invention generally concerns a submersible well pumping system comprising an axially elongated housing having a diameter less than the bore hole of the well, a multi-chamber hydraulically driven diaphragm pump, suspended in the well using coiled tubing, in which the coiled tubing contains one or more electrical cables to provide power to the pump from the surface. The pump is driven by a self-contained, closed loop hydraulic system, activated by an electric or hydraulic motor. The flow of working fluid into and out of the pumping chambers is controlled by a two state snap-acting valve, in turn controlled by a sensor which senses the proximity of the working diaphragm and generates an electrical signal to change the state of the valve, typically when either diaphragm reaches the bottom of the pumping stroke. This arrangement of pump, coiled tubing and electrical cable allows the functions of pump suspension, transmission of electrical power and conveyance of pumped fluid to be combined into a single physical unit for maximum efficiency.

24 Claims, 3 Drawing Sheets

SUBMERSIBLE WELL PUMPING SYSTEM

This application is a continuation of U.S. provisional application 60/012,462, filed Feb. 28, 1996.

BACKGROUND

1. Technical Field

This invention relates generally to submersible well pumping systems. This invention relates particularly to a positive displacement pumping system enclosed in a housing and comprising a multi-chamber hydraulically driven diaphragm pump, which uses a coiled tubing to simultaneously supply power and convey fluids.

2. Description of the Background Art

Hydraulically driven diaphragm pumps are positive displacement pumps which are nearly immune to the effects of sand in the pumped fluid because the pressure generating elements are isolated from the pumped fluid by a flexible diaphragm. In well pump applications, this type of pump is driven by a self contained, closed hydraulic system, activated by an electric or hydraulic motor where the pump, closed hydraulic system, and the motor are enclosed in a common housing and submerged in a well. There are many examples of this type of well pump in the patent literature, but currently none are in use as well pumps because of high cost and/or poor reliability. In well pump applications, the key design feature in pump systems is the method used to redirect or reverse the flow of working fluid from the fluid source, referred to as the auxiliary pump, to the working fluid sub-chamber. The reversal of the flow causes the pumped fluid to move into and out of a pumping fluid sub-chamber through check valves, accomplishing the pumping action.

U.S. Pat. No. 2,435,179 discloses a hydraulically driven diaphragm pump which uses a hydraulically actuated valve to reverse the flow of working fluid. The valve is driven by differential pressure between the fluid inside (working fluid) and the fluid outside (pumped) the working diaphragm. Normally, no differential pressure exists between the two volumes. The pump creates the differential pressure required to reverse the pump by forcing the diaphragm against the walls of the pumping chamber which has the disadvantage of creating diaphragm stress, which can lead to premature diaphragm failure. A more significant problem occurs in low volume applications. The nature of the pump requires that the hydraulically actuated valve be driven by the same pressure source controlled by the valve, which causes the valve driving force to be released when the valve transverses an intermediate position between states. In low volume applications, the valve can stop in this intermediate position before it has completely reversed the pump. This can cause the pump to either dither (rapid but incomplete movement of the working fluid in one direction) or go into a mode where half the flow is directed into each chamber, which causes the pump to stop functioning.

U.S. Pat. No. 2,961,966 discloses another method to reverse the flow of working fluid by reversing the direction of rotation of the electric motor driving the auxiliary pump. This patent discloses a method to sense the differential pressure between the working fluid and the pumped fluid to activate the electrical braking and reversal of the electric motor driving the auxiliary pump. This method also leads to diaphragm stress because differential pressure is required across the diaphragm to actuate the sensor. In addition motor reversal requires very complex electronics. Although theoretically possible, in practice the complexity of this method leads to high expense and unreliable operation due to the difficulty of controlling and reversing the electric motor in a downhole environment. To power this type of submersible pump, an electrical supply cable is typically used to connect the power supply at the surface to the electrical motor at the bottom of the well. Conventional submersible pump cables are armored with rubber or metal covers and are typically strapped to the outside of the production tubing as the pump is installed in the well. These cables, although armored, routinely suffer mechanical damage which results in cable failure. To better protect power cables and reduce costs, electrical cables have been placed inside coiled tubing and used to power and suspend submersible pumps in wells. A key design feature is a means of attaching the electrical cable to the inside of the coiled tubing to transfer the weight of the electrical cable to the coiled tubing to prevent the electrical cable from breaking under it's own weight.

U.S. Pat. No. 4,346,256 and U.S. Pat. No. 4,665,281 disclose two methods of suspending electrical cables inside of coiled tubing. In the field, these methods suffered from cable failures due to differential expansion of the various materials of construction. U.S. Pat. No. 5,146,982 discloses a method of overcoming this problem using a controlled spiral cable lay which allows for differential expansion. All of these cables are designed to work with high flow rate centrifugal pumps, consequently, the electrical cables and the hangers fill almost the entire cross section of the inside of the coiled tubing, which requires the output of the pump to be directed into the space between the coiled tubing and the well casing as opposed to between the coiled tubing and the electrical cable.

A significant problem which results from using positive displacement well pumps, such as sucker rod pumps, is sand and other solids which can cause premature pump failure due to excessive wear. Another significant problem is the expense and reliability of mechanical actuation systems used to power these pumping systems from the surface. Electrically driven submersible centrifugal pumps such as those used in most water wells, can be easily installed on coiled tubing and offer reliable service and economical operation but cannot be used in relatively low volume-high pressure applications because of clogging of small openings and unacceptably low efficiencies.

A pumping system, like the one disclosed herein, which combines the high reliability and ease of installation on coiled tubing of a submersible centrifugal pump with the high efficiency in low flow-high pressure applications of a positive displacement pump constitutes a significant advancement in the state of the relevant art. The invention disclosed in this application allows coiled tubing to be used to convey well fluid from the pump to the surface and allow the electrical power cable to be housed inside the same coiled tubing. The combination of functions of the invention is not currently possible, because achievable centrifugal submersible pump flow rates at the required pressures are too high to be compatible with commonly used coiled tubing diameters. In addition, mechanical actuation systems used in the sucker rod pumps disclosed in the relevant art are incompatible with coiled tubing.

SUMMARY

The present invention is of submersible well pumping systems which use a positive displacement hydraulically driven diaphragm pump in conjunction with coiled tubing with one or more electrical power cables to provide efficient production of high pressure-low flow rate wells. The pump system of the present invention is attached to coiled tubing which house the electrical cables which provide power to the pump.

The primary pumping system of the invention comprises an axially elongated housing having a diameter less than the bore hole of the well, a pump with a plurality of pumping chambers of fixed volume, each pumping chamber is further subdivided into two sub-chambers, a working fluid sub-chamber and a pumped fluid sub-chamber, by a diaphragm, typically made of rubber. Each pumped fluid sub-chamber is connected via fluid passages to the wellbore through a check valve which allows well fluid to flow into the pumped fluid sub-chamber but prevents flow in the reverse direction. Likewise, pumped fluid sub-chamber is connected through a check valve which allows the well fluid to flow out of the pumped fluid sub-chamber to the coiled tubing assembly but prevents flow in the reverse direction. Such an arrangement allows well fluid to flow through the plumped fluid sub-chambers, thereby moving the pumped fluid from the wellbore to the coiled tubing assembly and eventually to the surface. In the preferred embodiment of the invention, the coiled tubing assembly comprises coiled tubing and contains the electrical power cable, which conveys the well fluid from the pump to the surface. The movement of well fluid into and out of the pumped fluid sub-chambers is caused by the insertion or withdraw of working fluid into and out of the working fluid sub-chambers. The movement of working fluid is caused by a closed hydraulic system which forces working fluid into one or more working fluid sub-chambers while simultaneously withdrawing working fluid from one or more opposed working fluid sub-chambers. The closed hydraulic system comprises an auxiliary pump, a control valve, the working fluid sub-chambers, and passageways. The passageways extend from the auxiliary pump to the control valve and from the control valve to the working fluid sub-chambers. The auxiliary pump, which can be a piston pump, gear pump, centrifugal pump or any type of pump which produces the required flow rates and pressures, provides inlet and outlet flows of working fluid. The control valve is connected to both the inlet and outlet of the auxiliary pump and to two sets of working fluid sub-chambers, each set comprising roughly equal displacement. The control valve has two states. In the first state, the inlet of the auxiliary pump is connected to one set of working fluid sub-chambers, and the outlet is connected to the other set of working fluid sub-chambers. In the second state, the control valve connects the set of working fluid sub-chambers previously connected to the input of the auxiliary pump, to the outlet of the auxiliary pump, and connects the input of the auxiliary pump to the set of working fluid sub-chambers previously connected to the output of the auxiliary pump. The valve changes states as a result of an electrical signal. This is accomplished using a linear solenoid, a rotary solenoid a piezoelectric device or similar device which converts an electrical signal to a mechanical motion to change the state of the valve. The electrical signal is generated by the input of sensors, which sense the position of the diaphragms in the pumping chamber. The sensor signals may be modified electrically by electronics located within the pump which amplify or change the character of the electrical signal to allow the use of a variety of devices to move the valve. The sensor or sensors determine when the associated diaphragm reach some predetermined point in the pumping chamber. Typically one sensor is used in each pumping chamber to sense the proximity of the pumping diaphragm, either at the top or the bottom of the pumping stroke. Many different types of proximity sensors could be used, for example, magnetic, optical, capacitive, contact and the like. Other sensor arrangements are possible, two sensors could be used in one pumping chamber, one to determine the top of the pumping stroke, and the other the bottom, and no sensors in the other pumping chamber. Other measurements could be made to determine the proximity of the pumping diaphragm such as determining differential pressure between the pumped fluid sub-chamber and the working fluid sub-chamber, in a pumping chamber, which would increase from zero when the pumping diaphragm is forced against the walls of the pumping chamber.

The auxiliary pump is driven by a prime mover which can be an AC or DC rotary electric motor, a AC or DC linear motor, a hydraulic motor or mechanical actuation from the surface. In the preferred embodiment of the invention, the prime mover is contained in the same housing as the pump, and is powered electrically. The pump may be connected to the motor in such a way that they share a common fluid supply, that is the same fluid is used in the electric motor as is used as the working fluid in the pump. In this arrangement, the fluid input of the auxiliary pump is connected to the electric motor fluid volume. This arrangement has the advantage of reducing the possibility of failure due to working fluid leakage around shaft seals, because the shaft seal between the pump and the motor is eliminated, which results in no moving seals between the working fluid and the well fluid. The fluid in the electric motor volume and working fluid in the closed hydraulic system in the pump expand and contract with temperature and pressure and must be equalized with the pump inlet to prevent pump and/or electric motor failure. Because the electric motor volume and the closed hydraulic system in the pump constitute one fluid volume, the working fluid sub-chambers compensate for this expansion and contraction for both the electric motor, volume and the closed hydraulic system in the pump, eliminating the need for a separate expansion compensation for each volume.

Another favorable arrangement is achieved by separating the electric motor fluid and the pump working fluid volumes through a shaft seal between the auxiliary pump and the electric motor. In this arrangement, different fluids with different properties can be used in each volume. To reduce the likelihood of failures, the shaft seal is situated between the motor fluid and pump working fluid volumes, and both are equalized using separate expansion compensation to the pump inlet so that no differential pressure exists across the seal. This is accomplished by equalizing the electric motor to the pump inlet through an expansion diaphragm in the motor and by separately equalizing the closed hydraulic system in the pump, which is also equalized to the pump inlet by the working fluid sub-chambers.

Because the pump system of the invention suffers no loss of efficiency with variations in motor speed, it is the ideal choice for variable production rate or variable power availability situations such as solar and wind or when changes in well production rate are desired. This could be achieved in an electrically powered system by using an AC induction motor and varying the speed through any of several methods, including variable frequency or phase control. Another method could use a brushless DC motor that varies in speed according to the applied voltage or a separately supplied synchronizing signal from the surface. In addition, the pump speed may be measured to provide accurate production rate information. This could be accomplished by either separate sensors such as tachometers or tooth type magnetic pickups on the prime mover or by monitoring the AC power, synchronizing signals or other waveforms applied to the prime mover. Other uses of the pump system of the invention are envisioned, such as dewatering, feedwater, sewage, booster pumps and other situations where solid containing fluids are pumped to high pressure at low volumes.

By using a hydraulically driven diaphragm pump in conjunction with coiled tubing, the invention allows the overall well production system to be improved by combining the functions of pump suspension, conveyance of the pumped fluid to the surface and conveyance of electrical power from the surface to the pump into a single coiled tubing assembly. The coiled tubing assembly of the invention comprises a standard coiled tubing, insulated electrical cables which are contained inside the tubing and hangers which connect the conductors to the inside of the tubing. The hangers may be attached to the coiled tubing by friction as the assembly is being manufactured or by subsequent exposure of the hanger to elevated temperatures or chemicals, such as polar or non-polar solvents. A relatively large space is created between the electrical cables and the inside of the coiled tubing by the hangers. The relative sizes of the coiled tubing, the electrical cables, and passageways through the hangers are sized to convey well fluid from the pump to the surface with an acceptable pressure drop. The arrangement of the invention eliminates the need for physical cable protection, lowering the overall cost of the cable.

To prevent cable failures, allowance must be made for the coiled tubing and the electrical cable to expand and contract relative to each other. In this invention, the space between the coiled tubing and the electrical cable, which is relatively large, allows the electrical cables to expand or contract into or out of this space, changing geometry to accommodate differential expansion. For example, if the electrical cables lengthen relative to the coiled tubing due to heating, the electrical cables expand into the space between the electrical cable and the coiled tubing, changing shape from a straight line to a curved shape inside the tubing. The arrangement of the electrical cables and the coiled tubing accommodate differential expansion, preventing the electrical cables from experiencing excessive compressive forces which could cause a conductor to buckle. Accordingly, the invention allows the use of materials with differing thermal expansion rates in the construction of the coiled tubing assembly.

The enclosed electrical cables of the invention are surrounded by the pumped fluid from the pump to the surface, enabling the coiled tubing assembly to provide the additional benefit of a reduction in scale and paraffin buildup in the tubing as a result heat transfer between the electrical cable and the pumped fluid. This transfer compensates for heat loss in the pumped fluid which occurs when the fluid moves from the bottom of the well to the surface. By keeping the pumped fluid at a higher temperature, various organic and inorganic materials remain dissolved in the pumped fluid, preventing buildup in the tubing. Electrical heating is the result of current passing through a resistor. Because the electrical power cables are providing current to the motor and they have electrical resistance, the electrical cables provide heat as a result of the cables providing electrical current to the motor.

The transfer of heat from the electrical cable to the fluid has the additional advantage of keeping the electrical cable cooler than it would be if it were placed outside of the tubing, thus increasing cable lifetime. In most cases, this phenomena provides enough heat to maintain the temperature of the pumped fluid, but if additional heat is required, it can be provided by passing current through an additional cable or cables placed into the coiled tubing assembly, and/or by passing current through discrete heaters which are incorporated into the spacers. Discrete heaters at each spacer can provide the additional advantage of reducing paraffin or scale buildup at the spacer which can be a problem in some installations.

BRIEF DESCRIPTION OF THE DRAWINGS

These and other features, aspects and advantages of the present invention will become better understood with regard to the following description, appended claims and accompanying wings, where:

DESCRIPTION OF THE PREFERRED EMBODIMENT

Figure 1:
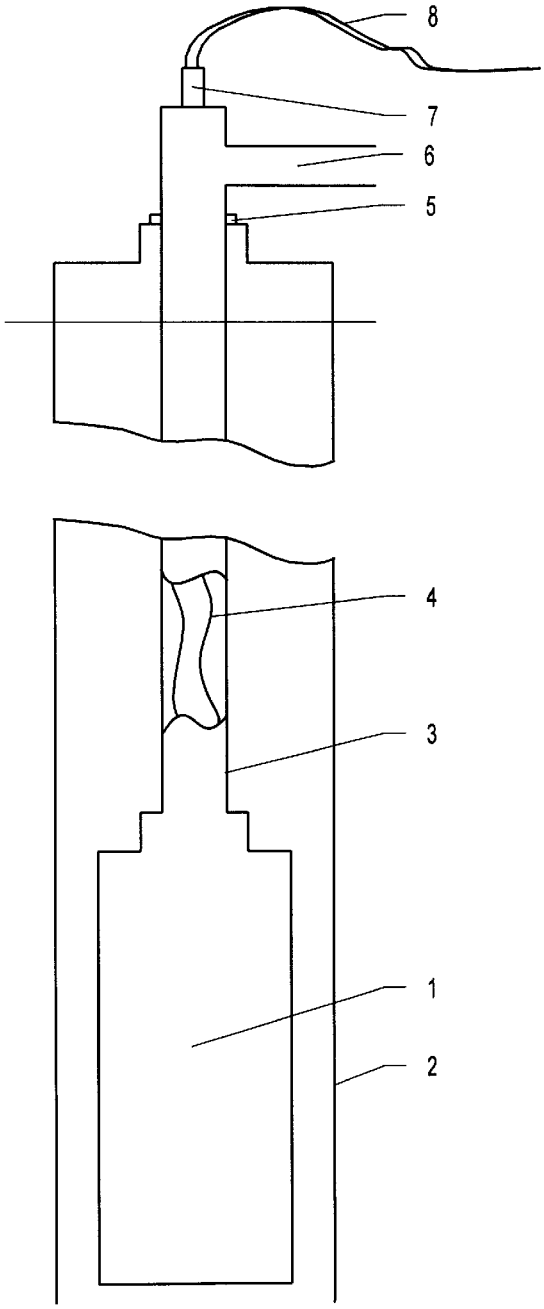
FIG. 1 is a cross sectional schematic view of the pumping system as it would be in installed in a typical well.

Referring now to the drawings, and particularly to FIG. 1, 1 is the hydraulically driven diaphragm pump of this invention installed in a typical well casing 2, beneath well head 5. The pump is suspended in the well using thin walled coiled tubing, 3 which contains inside one or more electrical power cables 4. Fluid is pumped by the pump 1 through the coiled tubing, 3 to the surface where it is collected at manifold 6. Electrical connections are made at the wellhead to the electrical cable contained inside the coiled tubing via pressure tight electrical connector 7. Electrical power is supplied to the wellhead through standard wiring 8.

Figure 2:
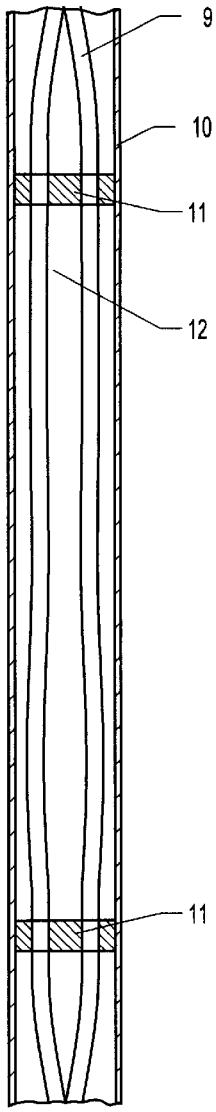
FIG. 2 is an enlarged, cross sectional view of the coiled tubing assembly. This view shows typical cable geometry at one limit of differential thermal expansion. Two cables are shown but this arrangement can be used for a plurality of cables as needed.

Referring now to FIG. 2. When the electrical cables 9, are at the lower limit of differential thermal expansion, the geometry of the cables is as shown in FIG. 2. The cables 9 are attached to hanger 11 which is typically made of plastic, but could be made of other materials such as metals or rubber and could contain discrete heaters used to maintain the temperature of the pumped fluid and keep the hanger free from build up. Hanger 11 could be made in a variety of geometries, depending on flow requirements and is attached to cables 9 by an interference fit which is developed when the tubing assembly is manufactured. Hanger 11 is in turn attached to the inside of coiled tubing 10 also by an interference fit which is developed when the cable is manufactured. Other methods could be used to attach the hanger 11 to the cables 9 and the coiled tubing 10 such as friction, adhesives and material expansion due to heat or chemical exposure. Hangers 11 are typically located at approximately 10 foot intervals along the inside of the coiled tubing 10. Hangers 11 may contain heaters (81) or be electrically conductive such that current may be passed through them to provide heat. Space 12 allows for pumped fluid to flow up the tubing, between the cables 9 and the coiled tubing 10. The coiled tubing 10, the electrical cables 9 and the hangers 11 constitute the coiled tubing assembly.

Figure 3:
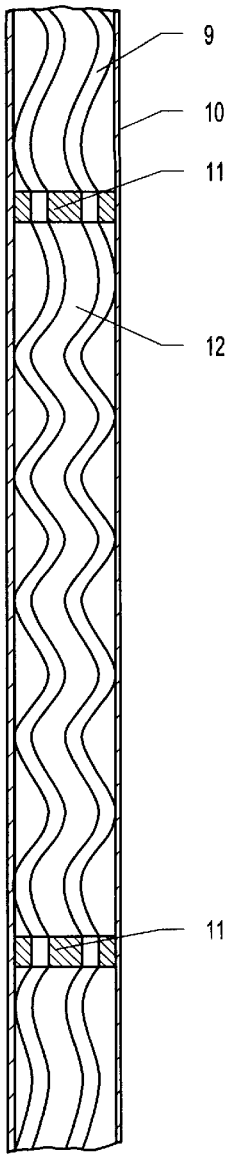
FIG. 3 is an enlarged, cross sectional view of the coiled tubing assembly. This view shows typical cable geometry at the other limit of differential thermal expansion.

FIG. 3 shows the same coiled tubing assembly as FIG. 2 at the upper limit of differential thermal expansion. The cables 9 assume a curved shape as a result of thermal expansion. The assembly can be manufactured to either accommodate differential thermal expansion of the tubing greater than the cable or of the cable greater than the tubing by adjusting the relative lengths of the coiled tubing 10 and the electrical cables 9.

Figure 4:
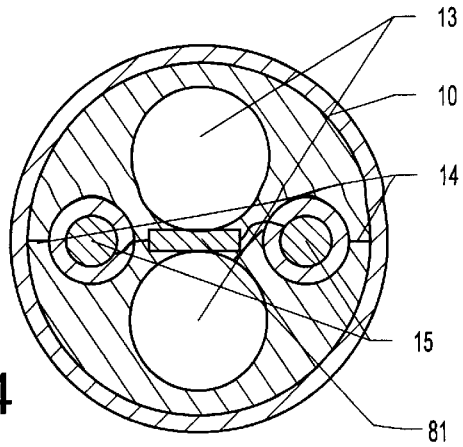
FIG. 4 is a cross sectional view of the coiled tubing assembly taken through a hanger to show a typical cross section.

Referring now to FIG. 4, holes 13 allow for the flow of pumped fluid through the hanger. A typical configuration is shown, but others are clearly possible, as long as the cross sectional area is large enough to accommodate the flow required. Electrical cables 15, are held tightly in hanger 11 by an interference fit. Slots 14 accommodate the assembly of the hanger onto the electrical cable 15 prior to assembly into the coiled tubing 10.

Figure 5:
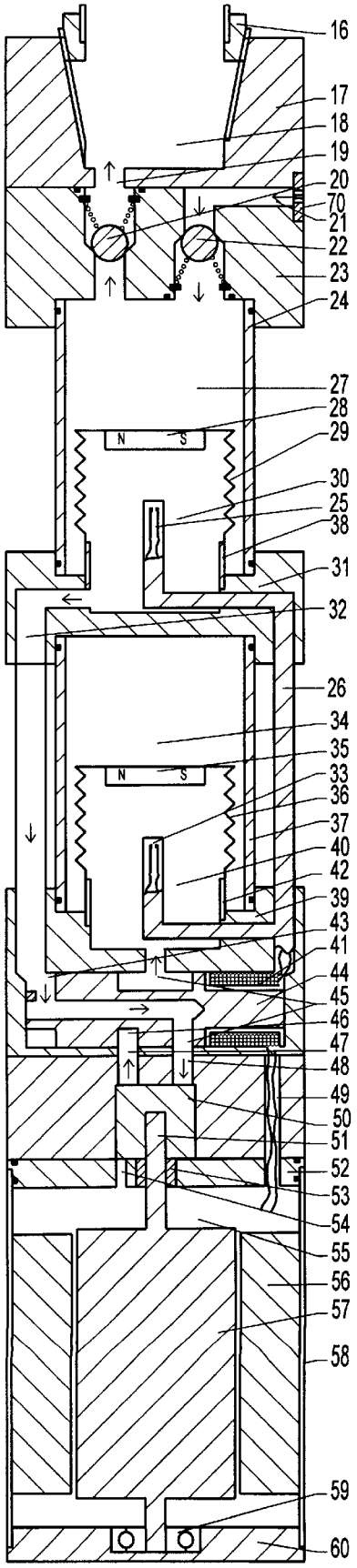
FIG. 5 shows a cross sectional view of a version of the hydraulically driven diaphragm pump. The spool valve is shown in position 1.
Figure 6:
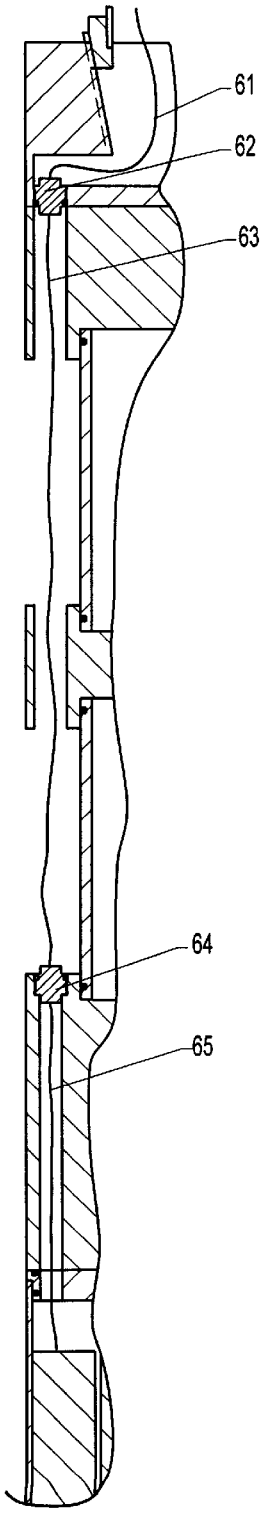
FIG. 6 is a cross sectional detail of the hydraulically driven diaphragm pump taken at 22.5 degrees to FIG. 5 showing a typical electrical connection.
Figure 7:
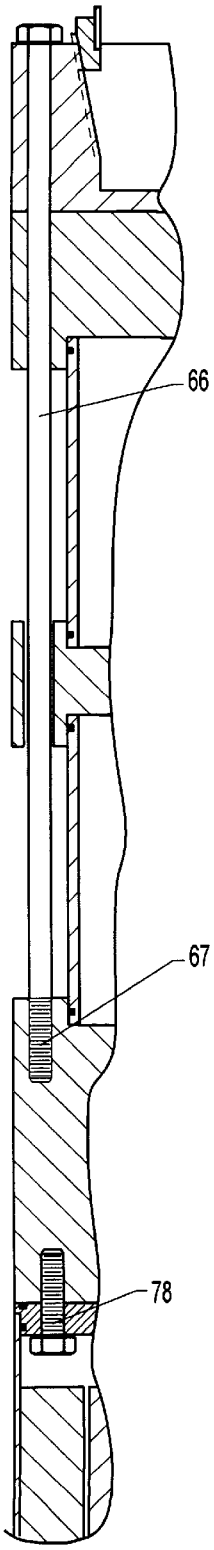
FIG. 7 is a cross sectional detail of the hydraulically driven diaphragm pump taken at 45 degrees to FIG. 5 showing a typical bolting arrangement.
Figure 9:
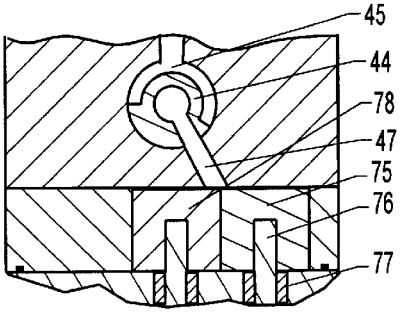
FIG. 9 is a cross sectional detail of the improved hydraulically driven diaphragm pump taken at 90 degrees to FIG. 5 showing details of the hydraulic valve and auxiliary pump.
Figure 11:
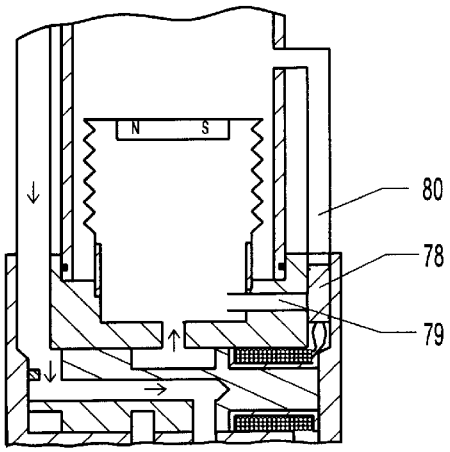
FIG. 11 is a cross sectional detail showing the alternate differential pressure sensor.

Referring to FIG. 5 and FIG. 6. Coiled tubing assembly 16 attaches to the pump head 17 with a pipe type thread. Stator 56 is connected to cable 65 which is in turn connected to pressure proof feedthrough 64. The pressure on each side of feedthrough 64 equalized with the wellbore through volume 55, and passageway 54 which is connected to the low pressure side of auxiliary pump 50. Cable 63 connects to pressure proof feedthrough 64 to pressure proof feedthrough 62. Cable 61 is connected to the electrical cable in the coiled tubing assembly 16. One connection between stator 56 and coiled tubing assembly 16 is shown, normally one or more identical connections is required, located around the periphery of the pump. Power from the surface causes stator 56 to turn rotor 57. Power can be in the form of alternating or direct current, depending on the electrical motor type. If DC power is used, commutating electronics (Not Shown) would be needed. These would be located in a potted block in the motor volume. Shaft 51 is connected to rotor 57, supported on bearings 59 and 53. Referring to FIG. 9 and FIG. 5, Auxiliary pump 50, comprising of gears 75 and 78 mesh to create a positive displacement pump, when enclosed in auxiliary pump housing 39 and auxiliary pump base 52. Gears 75 and 78 are supported on shafts 76 and 51 which rotate on bearings 77 and 53. Auxiliary pump 50 is driven by shaft 51. Motor housing 58 is attached to plate 60 and auxiliary pump base 52 to enclose the electric motor assembly. This assembly is attached to auxiliary pump housing 39 with bolts 78 as shown in FIG. 7. Referring back to FIG. 5, the entire electric motor assembly is sealed, except for passageway 54 which leads to the low pressure side of auxiliary pump 50. Alternatively, the motor assembly may be completely sealed and a separate equalization diaphragm used within the motor assembly. This allows the use of an off the shelf electric motor such as a Franklin "Stripper" motor which has built in pressure equalization and shaft seals. This alternative arrangement also allows the use of two different fluids, one for the motor and one for the pump. In this arrangement, there is no differential pressure between the two volumes, because both are equalized to the pump inlet which minimizes the possibility of fluid migration between the two volumes. A variety of auxiliary pump types could be used including gear, axial piston, vane centrifugal or any other type which produces proper flow rates and pressures. The rotation of auxiliary pump 50 causes high pressure working fluid, typically refined mineral oil, to flow out of auxiliary pump 50 through passageway 47 and likewise, causes low pressure working fluid to flow into auxiliary pump 50 through passageway 48. The flow of working fluid is controlled by spool 44. The working fluid contained in upper working fluid sub-chamber 30 and lower working fluid sub-chamber 40 is separate from the pumped fluid. This same volume of working fluid fills the spool valve 44, auxiliary pump 50 and electric motor fluid volume 55 and all chamber and passageways associated with these parts. The working fluid comprises a fixed amount of working fluid, this fixed amount of working fluid is sealed from the other areas of the pump and is the closed hydraulic system. Upper working fluid sub-chamber 30 is connected through passage 32 and 43 to the inside of spool 44. Similarly, lower working fluid sub-chamber 40 is connected to passage 45, on the outside of spool 44. Spool 44 can be rotated by solenoid 41 which is connected to the electrical power supply by electrical cable 49. Solenoid 41, is a rotary solenoid, available from multiple suppliers, including Lucas Ledex, and is a two position DC solenoid (driven in both directions). A rotary solenoid is used in the preferred embodiment, but a linear solenoid or an electrically piloted, hydraulically powered valve could be used to perform the same function. Parker Hydraulics DS084b, which is a two position, four port linear control valve, could be used as a direct replacement for the spool (44) and solenoid (41) shown in the preferred embodiment. Since this valve relies on a return spring, additional electronics, located in the motor volume, are needed to produce the signals required by the solenoid. The flow of current to the solenoid is controlled by switches 25 and 33. Switches 25 and 33 are normally open, but close when magnets 28 and 35 are in close proximity. These switches are commercially available reed switches but hall effect switches could be used. If hall effect switches are used, additional electronics, located in the motor volume are needed. Other types of switches, such as capacitive and inductive switches could be used to sense the proximity of the diaphragm, by replacing the magnet shown with a metal plate and replacing the switch shown in the preferred embodiment with a similar capacitive or inductive switch. If an optical sensor is used, it would directly replace the magnetic sensor shown in the preferred embodiment and the magnet would not be required. Alternatively, sensors could detect the displacement of the auxiliary pump by sensing and integrating the rotation of the pump shaft to determine the switching of the solenoid 41. Tubing 26 connects the switches to the solenoid 41. Referring to FIG. 11, an alternate sensor configuration to the preferred embodiment is deferential pressure sensor, 78 connected to lower working fluid chamber 40 through conduit 79 while the other side of the differential pressure sensor 76 is connected to the lower pumped fluid chamber 34 through conduit 80. As the pump operates, the differential pressure switch provides a signal when the diaphragm reaches the either limit of the pumping stroke.

Referring to FIGS. 5 and 9. The pumping action is controlled by spool 44. When spool 44 is in position 1, mineral oil flows from auxiliary pump 50 through passages 46, 43 and 32 into the upper hydraulic pump fluid sub-chamber 30. The well fluid in upper pumping chamber 27 is separated from upper hydraulic pump chamber 30 by rubber diaphragm 29. The upper pumped fluid sub-chamber 27, the upper working fluid sub-chamber 27 and the diaphragm 29 comprise the upper pumping chamber. Diaphragm 29 is attached to ring 38 which is attached to plate 31. Because upper hydraulic pump chamber 30 and upper pump chamber 27 enclose a fixed volume defined by upper pumped fluid sub-housing 24, check valve housing 23 and plate 31, the increase in the volume, caused by the flow of working fluid into upper working fluid sub-chamber 30 forces the volume of upper pumped fluid sub-chamber 27 to decrease by forcing pumped fluid to exit through check valve 20 through passage 19, volume 18 and out coiled tubing assembly 16. Likewise, mineral oil flows into auxiliary pump 50 through passage 45 from lower hydraulic pump chamber 40. The well fluid in lower pumped fluid sub-chamber 34 is separated from lower hydraulic pump chamber 40 by rubber diaphragm 36. The lower pumped fluid sub-chamber 34, the lower working fluid sub-chamber 40 and the diaphragm 36 comprise the lower pumping chamber. Diaphragm 36 is attached to ring 42 which is attached to auxiliary pump housing 39. Diaphragms 29 and 36 are typically made of rubber, but other materials can be used such as metals, plastics and composites.

Figure 8:
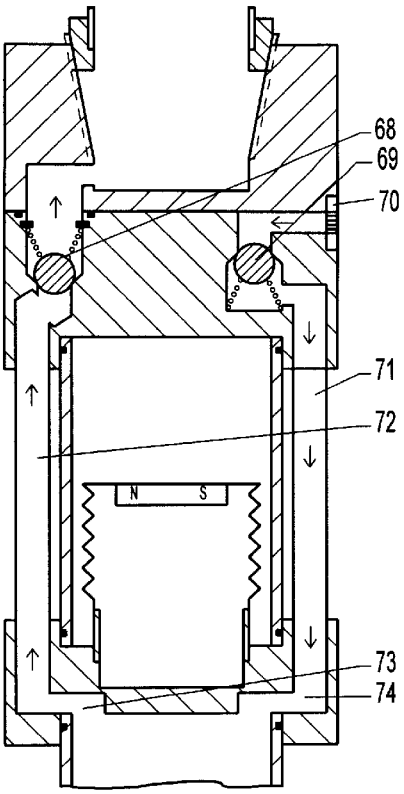
FIG. 8 is a cross sectional detail of the hydraulically driven diaphragm pump taken at 90 degrees to FIG. 5 showing the check valves for the lower pumped fluid sub-chamber.

Referring to FIG. 8, the lower hydraulic pumped fluid sub-chamber 40 and lower pump chamber 34 enclose a fixed volume defined by plate 31, pump housing 37 and auxiliary pump housing 39, the decrease in the volume caused by the flow of working fluid out of lower working fluid sub-chamber 34 forces well fluid from the well bore to flow through pump inlet 70, through check valve 69 through passage 71 and passage 74 into lower pumped fluid sub-chamber 34. To decrease the tendency of sand and other insoluble materials to settle into the pumped fluid sub-chamber, a dip tube which extends from the check valve to the lowest point in the pumping chamber can be installed.

Figure 10:
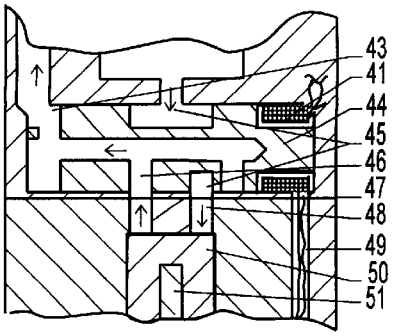
FIG. 10 is a cross sectional detail showing the spool valve in position 2.

Referring to FIGS. 5 and 10, when spool 44 is in position 2, working fluid flows from auxiliary pump 50 through passage 45 into lower hydraulic pump chamber 40. This causes the volume of fluid in lower pumped fluid sub-chamber 34 to decrease by forcing fluid to exit through passage 73 into passage 72 through check valve 68 into fluid volume 18 and out coiled tubing assembly 16. Likewise, working fluid flows into auxiliary pump 50 through passage 48 from passage 45, from passage 43 from passage 32 from upper hydraulic pump chamber 30. This causes the volume of fluid in upper pumped fluid sub-chamber 27 to decrease, which forces fluid from the well bore into through pump inlet 70, through passage 21 through check valve 22 into upper pumped fluid sub-chamber 27. Spool 44 is driven to position 1, as shown in FIG. 5 after switch 33 closes due to the proximity of magnet 35 when the lower diaphragm 38 reaches the top of its pumping stroke. This causes spool 44 to rotate and connect passage 48, which is connected to the input of auxiliary pump 50, to passage 45. At the same time, passage 47 which is connected to the output of auxiliary pump 50 is connected to passage 43. The rotation of spool valve 44 causes the reversal of the pumping stroke.

Spool 44 is driven to position 2, as shown in FIG. 10, after switch 25 is closed by the proximity of magnet 28, upper diaphragm 29, which occurs when the upper diaphragm 29 reaches the top of the pumping stroke. This state causes spool 44 to rotate and connect passage 48, which is connected to the input of auxiliary pump 50 to passage 43. At the same time, passage 47 which is connected to the output of auxiliary pump 50 is connected to passage 45. The rotation of the spool valve 44 causes the reversal of the pumping stroke.

What is claimed is:

1. A well pumping system comprising:

a) an axially elongated housing having a diameter less than the bore hole of the well;

b) a plurality of rigid pumping chambers formed in the housing and enclosing pumping fluid and working fluid in a fixed volume;

c) flexible diaphragm means dividing each pumping chamber into two sub-chambers thus separating the pumped fluid from the working fluid;

d) pump inlet means connected to the pumped fluid sub-chamber;

e) pump outlet means connected to the pumped fluid sub-chamber;

f) inlet check valve means per pumped fluid sub-chamber extending between the pump inlet and each pumped fluid sub-chamber allowing unidirectional flow of pumped fluid from the pump inlet means to the pumped fluid sub-chamber;

g) outlet check valve means extending from the pump outlet means to each pumped fluid sub-chamber allowing the unidirectional flow of pumped fluid from the pumped fluid sub-chamber to the pump outlet means;

h) a closed hydraulic system filled with working fluid;

I) an auxiliary pump circulating working fluid through the closed hydraulic system;

j) a two-state control valve engaged to the closed hydraulic system, extending between the auxiliary pump and the working fluid sub-chambers to alternately insert and simultaneously withdraw working fluid to the working fluid sub-chambers;

k) control valve actuation means providing mechanical motion to change the state of the control valve;

l) sensor means electrically connected lo the control valve actuation means to detect the proximity of the diaphragm means; and m) prime moving means attached to the auxiliary pump, driving the auxiliary pump and filled with prime mover fluid.

2. A well pumping system according to claim 1 wherein the auxiliary pump is a positive displacement pump.

3. A well pumping system according to claim 1 wherein the control valve is a rotary device.

4. A well pumping system according to claim 1 wherein the control valve is a linear device.

5. A well pumping system according to claim 1 wherein the control valve actuation means converts electrical to mechanical energy using electromagnetic means.

6. A well pumping system according to claim 1 wherein the sensor means used to detect the proximity of the diaphragm means is a magnetic sensor.

7. A well pumping system according to claim 1 wherein the sensor means used to detect the proximity of the diaphragm means is a capacitive sensor.

8. A well pumping system according to claim 1 wherein the sensor means used to detect the proximity of the diaphragm means is an optical sensor.

9. A well pumping system according to claim 1 wherein the sensor means used to detect the proximity of the diaphragm means is a differential pressure sensor.

10. A well pumping system according to claim 1 wherein the prime moving means moves in a rotary fashion, is moved by electric power, the magnitude of the power is measured to determine pumping rate, and variable pumping rates are achieved by changing the characteristics of the electric power.

11. A well pumping system according to claim 1 wherein the prime moving means moves in a linear fashion, is moved by electric power, the magnitude of the power is measured to determine pumping rate, and variable pumping rates are achieved by changing the characteristics of the power.

12. A well pumping system according to claim 1 wherein the prime mover fluid and the working fluid are connected by a fluid filled conduit, and the diaphragm means provides for the expansion of both the working fluid and the prime mover fluid.

13. A well pumping system according to claim 1 wherein the axially elongated housing is completely filled with working fluid and prime mover fluid, with the flexible diaphragm means in such an arrangement as to provide a seamless barrier with no moving seals.

14. A well pumping system according to claim 1 wherein the prime mover fluid is pressure-compensated to the pump inlet, and the working fluid in the axially elongated housing is pressure-compensated to the pump inlet such that pressures between the two fluids are equalized.

15. An apparatus for supporting a well pumping system, comprising:

a) cable means providing power to drive the prime mover from the surface of the well;

b) suspension means, having an interior side and an exterior side, frictionally engaged to the pump head providing suspension of the pumping system in the well and providing sufficient space between the cable means and the suspension means to allow conveyance of the pumped fluid and conveyance of the cable means from the well pumping system to the surface of the well, and to accommodate differential expansion of the suspending means and the cable means;

c) a plurality of hangers allowing frictional engagement of the cable means to the suspension means;

d) a plurality of hanger passageways allowing the pumped fluid to pass through the hanger means; and e) a plurality of hanger heaters frictionally engaged to the hanger passageways.

16. An apparatus to support well pumping systems according to claim 15 wherein the suspending means comprises metallic jointed pipe.

17. An apparatus to support well pumping systems according to claim 15 wherein the suspending means comprises non-metallic jointed pipe.

18. An apparatus to support well pumping systems according to claim 15 wherein the suspending means comprises thin-walled continuous tubing.

19. An apparatus to support well pumping systems according to claim 15 wherein the cable means extend through the interior side of the suspension means.

20. An apparatus to support well pumping systems according to claim 15 wherein the hangers are frictionally engaged to the suspending means through an interference fit.

21. An apparatus to support well pumping systems according to claim 14 wherein the hangers are frictionally engaged to the suspending means through expansion of the hangers as a result of exposure to elevated temperatures.

22. An apparatus to support well pumping systems according to claim 15 wherein the hangers are frictionally engaged to the suspending means through irreversible expansion of the hangers as a result of chemical exposure.

23. An apparatus to support well pumping systems according to claim 15 wherein the proximity of the cable means heats the pumped fluid while traveling through the apparatus to support well pumping systems.

24. An apparatus to support well pumping systems according to claim 15 wherein the proximity of the hanger heaters heats the pumped fluid is heated while traveling through the apparatus to support well pumping systems.

* * * * *